United States Patent [19]

Ogihara et al.

[11] 4,251,878

[45] Feb. 17, 1981

[54] SWITCHING DEVICE FOR BATTERY POWERED ALARM CLOCK

[75] Inventors: Masuo Ogihara; Kozo Chimura; Nobuo Shinozaki, all of Shikawatashi, Japan

[73] Assignee: Seiko Koki Kabushiki Kaisha, Tokyo, Japan

[21] Appl. No.: 918,919

[22] Filed: Jun. 26, 1978

[30] Foreign Application Priority Data

Jun. 30, 1977 [JP] Japan ..... 52-86692[U]

[51] Int. Cl.[3] ..... G04C 21/16; H01H 43/10

[52] U.S. Cl. ..... 368/257; 368/265; 200/35 R; 200/37 R

[58] Field of Search ..... 58/79 R, 19 A, 20, 22, 58/38 R, 39, 57.5, 152 B, 38 A; 200/35, 36, 37 R, 38 A, 38 C

[56] References Cited

U.S. PATENT DOCUMENTS

| | | | |
|---|---|---|---|
| 3,643,421 | 2/1972 | Herr et al. | 58/19 A |
| 3,996,734 | 12/1976 | Kitai et al. | 58/16 R |
| 4,015,417 | 4/1977 | Katai et al. | 58/38 R |
| 4,070,822 | 1/1978 | Arai | 58/16 D |

*Primary Examiner*—Edith S. Jackmon

*Attorney, Agent, or Firm*—Robert E. Burns; Emmanuel J. Lobato; Bruce L. Adams

[57] ABSTRACT

In a battery powered alarm clock, an alarm switching device comprises at least one detecting wheel whose phase is set in accordance with the desired alarm time, at least one detecting switch which is closed when the phase of the time wheel of the clock corresponds to that of the detecting wheel and a printed circuit board having alarm circuitry mounted thereon with at least one land for connecting the alarm circuitry to one pole of the battery. The alarm switching device construction provides solderless connection by at least two battery contact plates for contacting the two poles of the battery. One of the plates provides three electrical contacts including a first contact with one pole of the battery, a second contact with the land on the printed circuit board and a third contact with the detecting switch, whereby the assembly and construction of the clock is greatly simplified.

2 Claims, 4 Drawing Figures

SWITCHING DEVICE FOR BATTERY POWERED ALARM CLOCK

BACKGROUND OF THE INVENTION

This invention relates to an alarm clock including a battery powered electromechanical transducer for driving a gear train which actuates an electric alarm signaling device at a predetermined alarm signaling time.

In assembling conventional alarm clocks of this type, it is the usual procedure to connect with lead wires the electric circuit, time detecting switches, battery and the buzzer which are disposed independently of each other. This construction has the disadvantages that it requires too many lead wires so that extra space for wiring and extra assembling steps for soldering those lead wires is necessary and that it is difficult to fix due to the complicated wiring.

SUMMARY OF THE INVENTION

The object of this invention is to overcome the disadvantages of the conventional alarm clocks.

The object is attained by providing detecting wheels the phases of which are determined dependent upon the alarm signaling time setting, time wheels, detecting switches which are closed when the phases of the afore mentioned wheels are synchronized, and at least two contact plates connected to the clock battery, a part of the plates being a common terminal for the detecting wheels.

DETAILED DESCRIPTION OF THE PREFERRED EMBODIMENTS

Figure 1:
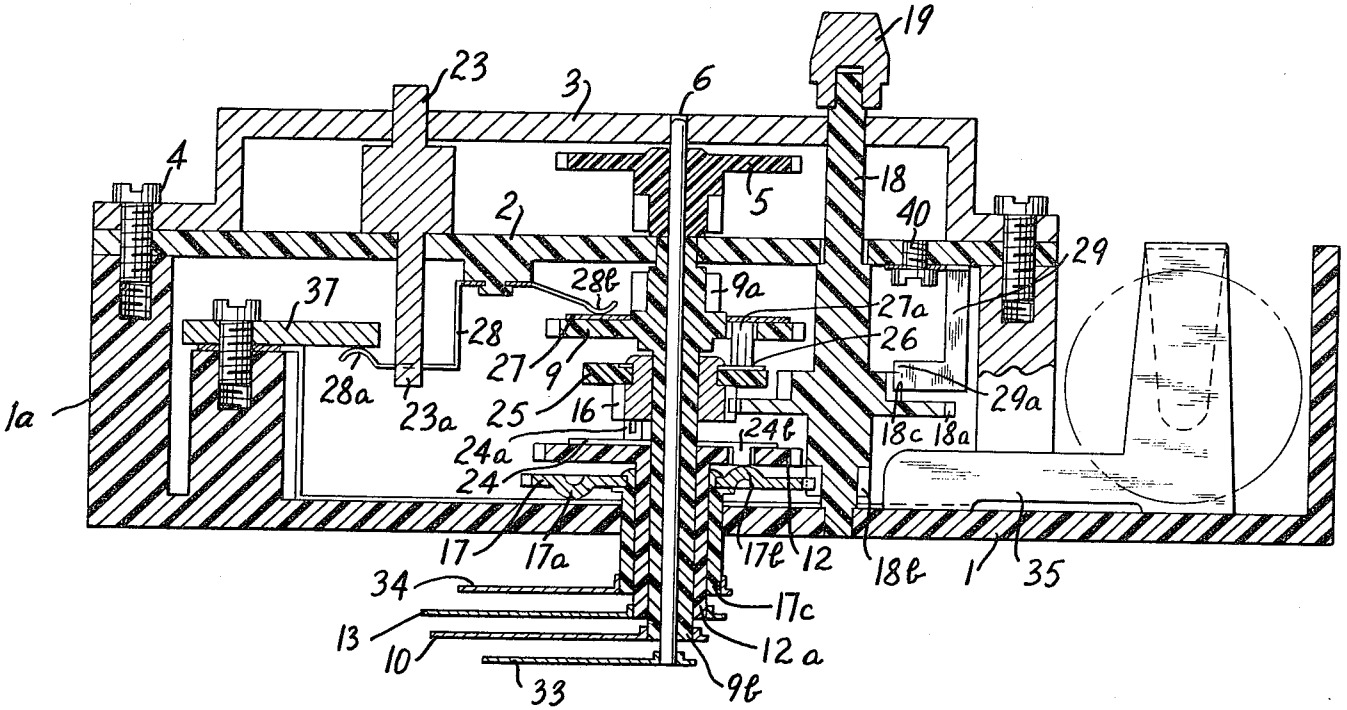
FIG. 1 is a sectional view of a first embodiment of the present invention.
Figure 2:
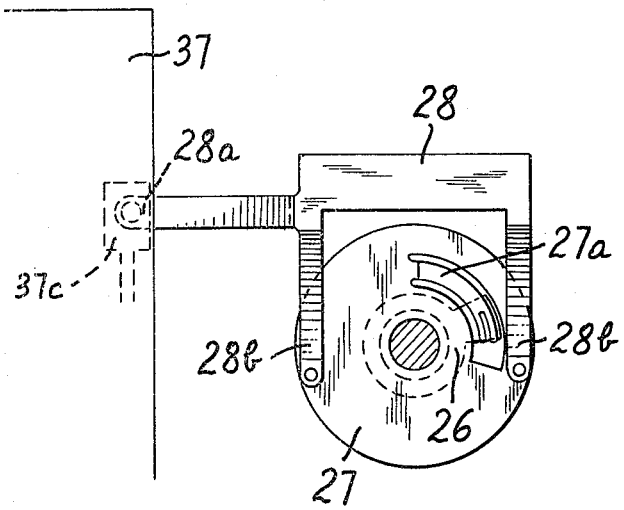
FIGS. 2 and 3 are partial plan views of FIG. 1.
Figure 3:
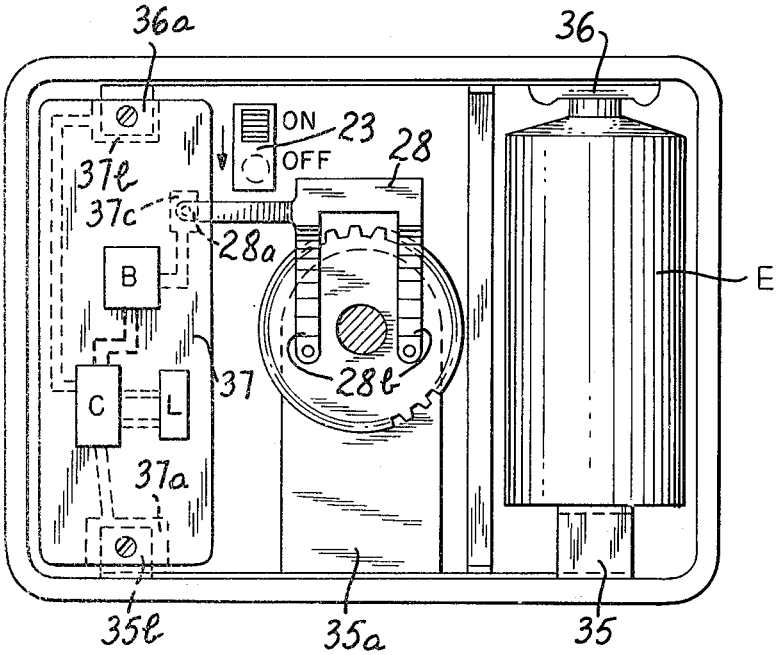

Referring now to FIGS. 1 to 3, inclusive, an explanation will be made of the first embodiment of the invention.

A case (1) molded of plastics has a projection (1*a*) on its left end and rotatably receives a tubular boss (17*c*) of an hour detecting wheel 17 and the shaft of an alarm signaling time setting wheel (18).

A middle frame 2 molded of plastics rotatably guides a minute wheel (9) and slidably guides an alarm setting push button (23).

A cover (3) molded of plastics rotatably guides a spindle (6) and the alarm signaling time setting wheel (18), and frictionally guides the alarm setting push button (23). A screw (4) fastens the cover (3) and the middle frame (2) to the case (1) at the projection (1*a*) of the case (1).

The following explanation is concerned with the gear train for time indication for the embodiment of FIGS. 1–3.

A second wheel (5) driven by an electromechanical transducer, not shown, is fixedly mounted on the spindle (6), spindle 6 also penetrates through a tubular boss (9*b*) of a minute wheel (9) and is provided with the second hand (33) at the tip thereof. The second wheel (5) is engaged with the minute wheel (9) indirectly through an intermediate wheel (not shown) having frictional coupling means, not shown, disposed there between. The minute wheel (9), a pinion (9*a*) and the tubular boss (9*b*) are molded of plastics in one body.

The tubular boss (9*b*) penetrates an hour wheel (12) and is provided with the minute hand (10) at the tip. The pinion (9*a*) is engaged with the hour wheel (12) through an intermediate hour wheel, not shown.

The hour wheel (12) and the tubular boss (12*a*) are molded of plastics in one body. The hour hand (13) is fixed at the tip of the tubular boss (12*a*).

The following explanation is concerned with the construction of the gear train for alarm signaling for the first embodiment of the alarm clock.

A minute detecting wheel (16) made of an electrically conductive material is rotatably fitted on the tubular boss (9*b*) between the minute wheel (9) and the hour wheel (12). An index (34) is fixed at the tip of a tubular boss (17*c*) fixedly assembled with an hour detecting wheel (17) made of an electrically conductive material.

An alarm signaling time setting wheel (18) comprises, in one body, of a first wheel (18*a*) and a second wheel (18*b*) engaged with the minute detecting wheel (16) and the hour detecting wheel (17), respectively, and a third wheel (18*c*). An alarm signaling time setting knob (19) is fixed to the alarm signaling time setting wheel (18) at the tip thereof. A clickstop spring (29) is fixed on the bottom surface of the middle frame (2) by a screw (40) and the tip thereof is engaged with the third wheel (18*c*) of the alarm signaling time setting wheel (18) causing the alarm signaling time setting wheel to effect a clickstop motion.

The following explanation is concerned with the construction of the alarm signaling time detecting device of the alarm clock of the first embodiment.

Referring first to FIG. 3, a negative contact plate (35) and a positive contact plate (36) are connected to the negative and the positive terminals, respectively of a battery (E), respectively. The negative contact plate (35) has a conductive part in the form of a first elongation (35*a*) extending to the center of the clock and another conductive part in the form of a second elongation (35*b*) at the left end of the clock with a tapped hole. The positive contact plate (36) has a raised part (36*a*) with a tapped hole at the left end of the clock.

A driving coil (L) of an electromechanical transducer, not shown, a buzzer (B) and a control circuit (C) are disposed on the surface of a printed circuit board (37), on the other side of which there is printed a pattern of an electric circuit for electrically connecting the abovementioned elements. A negative pattern (37*a*) and a positive pattern (37*b*) are connected to the terminals of the control circuit (C). The control circuit (C) controls the electric current for the driving coil (L) and the buzzer (B). A switch pattern (37*c*) is connected to the alarm terminal of the buzzer (B).

The buzzer (B) of this embodiment is actuated when the switch pattern (37*c*) and the negative pole of the electric power source are connected. The buzzer stop push button (23) which is movable between the On and Off positions has a working finger (23*a*) extending through the middle frame (2). A stationary contact plate (28) is fixed on the middle frame, with the right end (28*b*) always in sliding contact with the minute switch plate (27) and the left end (28*a*) extending under the switch pattern (37*c*) of the printed circuit board. The left end (28*a*) of the stationary contact plate is spring biased so as to be in contact with the switch pattern (37*c*). The working finger (23*a*) breaks the contact of the stationary contact plate (28) with the switch pattern (37*c*) when the buzzer stop push button (23) is pushed in to the Off position.

Referring again to FIG. 1, the hour detecting wheel (17) has a first projection 17*a* on the bottom surface and second projections (17*b*) on the upper surface disposed on different circles of different radii at equal angular intervals.

The negative contact plate (35) and the hour detecting wheel 17 are always connected electrically as the first projection (17*a*) is always in contact with the first elongation (35*a*) of the negative contact plate 35.

The hour switch plate (24) fixed on the hour wheel (12) has an upwardly extending slide contact piece (24*a*) and downwardly extending projections (24*b*) which project through the hour wheel and are disposed on different circles of different radii at equal angular intervals. The ends of the projections (24*b*) are almost in the plane of the bottom surface of the hour wheel (12). The phases of the second projections (17*b*) of the hour detecting wheel and the projections (24*b*) of the hour switch plate are synchronized once in twelve hours so that the hour detecting wheel 17 and the hour wheel 12 are electrically connected once in twelve hours. The hour switch plate 24 and the minute detecting wheel 16 are always in electrical contact as the slide contact piece (24*a*) is always in sliding contact with the bottom surface of the minute detecting wheel (16). An insulating disk (25) is made of an electrically nonconductive material. A sectoral switch plate (26) made of an electrically conductive material is formed in a planar shape as shown in FIG. 2.

The minute detecting wheel (16) and the sectoral switch plate (26) are joined with the insulating disk (25) in between by means of caulking so that the sectoral switch plate (26) and the minute detecting wheel (16) are electrically connected. A minute switch plate (27) having a downwardly extending slide contact piece (27*a*) is fixed on the minute wheel (9). The slide contact piece (27*a*) is normally in sliding contact with the insulating disk (25) and comes into electrical contact with the sectoral switch plate (26) once every hour. The right end (28*b*) of the stationary contact plate (28) is always in contact with the upper surface of the minute switch plate (27).

The following explanation is concerned with the operation of the first embodiment of the invention.

An alarm signaling time is set by the alarm signaling time setting knob (19). In this alarm signaling time setting procedure, the phases of the minute detecting wheel (16) and the hour detecting wheel (17) are determined so that the phases of the sectoral switch plate (26) and the second projections (17*b*) of the hour detecting wheel are determined at the same time. The left end (28*a*) of the stationary contact plate is electrically connected with the switch pattern (37*c*) by putting the buzzer stop button (23) in the On position.

Although the buzzer stop button 23 is turned on, the buzzer (B) will not be actuated because the sectoral switch plate (26) and the minute switch plate (27) or the hour detecting wheel (17) and the hour switch plate (24) have not yet been electrically connected. Although the minute detecting wheel (16) and the hour detecting wheel (17) are urged to turn due to the rotation of the hour switch plate (24) and the minute switch plate (27), they remain at the predetermined phases constrained by the click-stop spring (29) working on the alarm signaling time setting wheel (18). The minute switch plate (27) and the sectoral switch plate (26) come in contact once an hour, however, the buzzer will not be actuated before the hour wheel (12) reaches the predetermined phase. As time passes, in the first place the phases of the projections (24*b*) of the hour switch plate 24 and the second projections (17*b*) of the hour detecting wheel 17 are synchronized so that the hour switch plate 24 and the hour detecting wheel 17 are electrically connected. And while this connection is maintained, the slide contact piece (27*a*) of the minute switch plate and the sectoral switch plate (26) come into electrical contact.

Thus when those electrical contacts are made simultaneously, the buzzer is actuated in a series electric circuit comprising the negative contact plate (35)—the hour detecting wheel (17)—the hour switch plate (24)—the minute detecting wheel (16)—the sectoral switch plate (26)—the minute switch plate (27)—the stationary contact plate (28)—the switch pattern (37*c*).

The buzzer can be stopped by putting the buzzer stop button (23) in the OFF position to disconnect the left end (28*a*) of the stationary contact plate and the switch pattern (37*c*).

Figure 4:
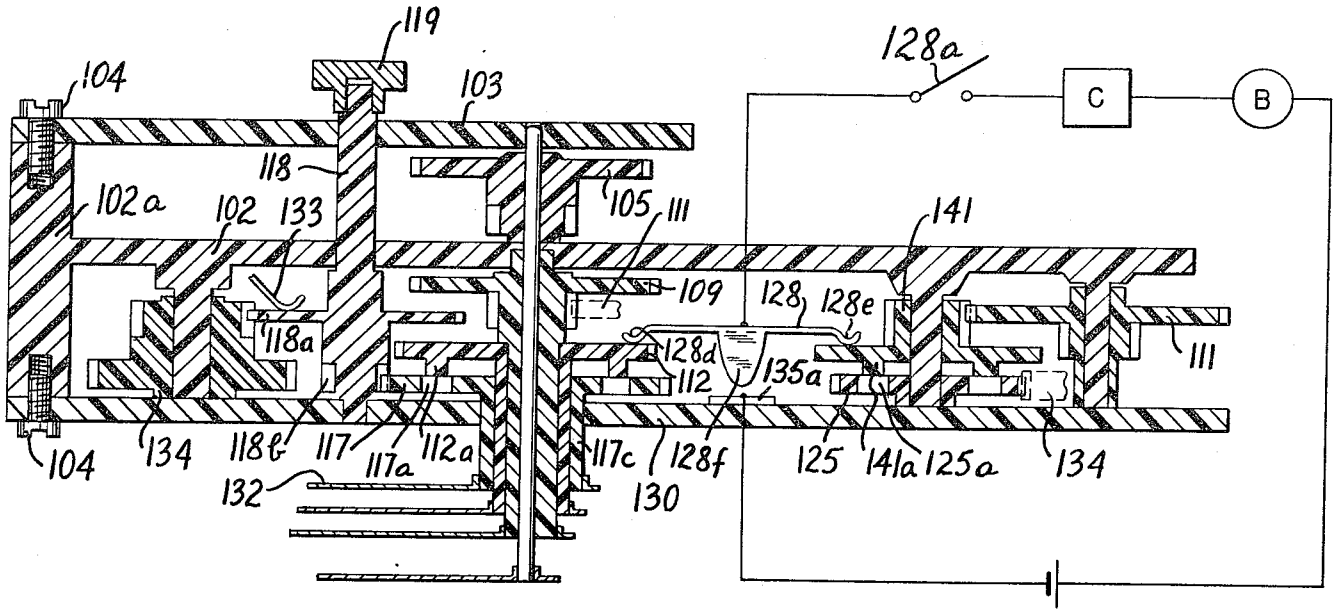
FIG. 4 is a sectional view of a second embodiment of this invention.

Referring now to FIG. 4, an explanation will be made of the second embodiment of the invention.

An upper cover (103) and a bottom cover (130) are assembled on to a middle frame (102), being fixed at the projection (102*a*) of the middle frame (102) by means of a screw (104). A gear train for time indication comprises, similarly to that of the first embodiment, a second wheel (105), an intermediate wheel provided with a frictional coupling mechanism, not shown, a minute wheel (109), an intermediate hour wheel (111) and an hour wheel (112).

The gear train for the alarm signaling device comprises a second minute wheel (141) engaged with the intermediate hour wheel (111) and rotating at the same rate as the minute wheel (109), a minute detecting wheel (125) disposed under the second minute wheel (141), an hour detecting wheel (117) disposed between the hour wheel (112) and the bottom cover (130) and provided with an index (132) at the tip of its tubular boss (117*c*), an alarm signaling time setting wheel (118) comprising a first wheel (118*a*) engaged with an idle wheel (134) and a second wheel (118*b*) engaged with the hour detecting wheel (117) and an alarm signaling time setting knob (9) fixed at the tip of its spindle. A friction breaking piece (133) is fixed to the middle frame (102) at one end and is pressed against the upper surface of the first wheel (118*a*) at the other end to provide a uniform frictional torque on the alarm signaling time setting wheel (118).

The following explanation is concerned with the alarm signaling time detecting mechanism of the second embodiment.

A first elongation (135*a*) is provided which is a part of the negative contact plate connected to the battery.

A stationary contact plate (128) is connected to the switch pattern of a printed circuit board by one of its terminals, not shown.

The other terminals are shaped in three forked elongations and are spring biased downwardly so that a first elongation (128*d*) and a second elongation (128*e*) are pressed against the hour wheel (112) and the second minute wheel (141), respectively, and a central third elongation (128*f*) extends downwardly so that it can come into contact with the first elongation (135*a*) of the negative contact plate.

A projection (112*a*) is provided on the bottom surface of the hour wheel (112). The hour detecting wheel (117)

has a hole (117*a*) at the position corresponding to the projection (112*a*).

The phases of the projection (112*a*) and the hole (117*a*) are synchronized once in twelve hours allowing the projection (112*a*) to fit into the hole (117*a*) so that the hour wheel (112) is pushed down by the spring (128). A projection (141*a*) is provided on the bottom surface of the second minute wheel (141). The minute detecting wheel (125) has a hole (125*a*) at the position corresponding to the projection (141*a*). The phases of the projection (141*a*) and the hole (125*a*) are synchronized once an hour allowing the projection (141*a*) to fit into the hole (125*a*) so that the second minute wheel is pushed down by the spring (128).

The following explanation is concerned with the operation of device of the second embodiment.

The minute detecting wheel (125) and the hour detecting wheel (117) are rotated by the alarm signaling time setting knob (119) through the wheels (118*a*) and (118*b*) of the alarm signaling time setting wheel and the idle wheel (134) to bring the holes (125*a*) and (117*a*) of the minute detecting wheel (125) and the hour detecting wheel (117), respectively, to the phases corresponding to the alarm signaling time. One terminal 128*a* of the stationary contact plate (128) and the switch pattern of the printed circuit board are connected by putting the to alarm stop button in On position.

At this initial moment, the buzzer (B) will not be actuated because the hour wheel (112) or the second minute wheel (141) has not come in to the phase corresponding to the alarm signaling time and the hour wheel (112) or the second minute wheel (141) is not pushed down by the spring (128) to make electrical connection. When the hour wheel (112) and the second minute wheel (141) come into the phases corresponding to the preset alarm signaling time, the projections (112*a*) and (141*a*) are brought directly above the holes (117*a*) and (125*a*), respectively, allowing the hour wheel (112) and the second minute wheel (141) to move downwardly as a result of being pressed by the spring (128) and at the same time, allowing the spring (128) itself to go downwards so that the third elongation (128*c*) comes into contact with the first elongation (135*a*) of the negative contact plate. Thus the alarm signaling circuit being completely closed, the buzzer is actuated.

Any explanations concerning the operation of the other mechanisms of the device will be omitted since they are quite similar to that of the first embodiment.

Although the alarm signaling time is detected by the hour and the minute in the two preferred embodiments, the minute's place of the alarm signaling time may be detected by means of the intermediate hour wheel, or in a modification, the alarm signaling time detecting mechanism may detect the hour's place omitting detection of minute's place.

It is also understood that the object of the invention is substantially attained by the device as described above, and furthermore, the assembling is considerably simplified by elimination of wiring and soldering so that the possibility of producing inferior clocks is reduced. Still further, the object of the invention is more fully attained by providing, as described in the first embodiment, the battery terminal contact plates with elongations which are directly connected with the power source pattern of the printed circuit board.

We claim:

1. In a battery powered alarm clock of the type having at least one time wheel; and an alarm switching device comprising at least one detecting wheel whose phase is set in accordance with a desired alarm time, at least one detecting switch which is closed when the phase of the time wheel corresponds to that of the detecting wheel and including switch plates for said time and detecting wheels which move into electrical contact with one another upon phase correspondence of said time wheel and detecting wheel, and a printed circuit board having alarm circuitry mounted thereon and having at least one land electrically connected to the alarm circuitry, the improvement wherein said alarm switching device further comprises solderless connecting means comprising at least two battery contact plates for contacting the two poles of the battery, wherein one of the battery contact plates has three electrically conductive parts including a first part making electrical connection with one pole of the battery, a second part making electrical connection with said land of said printed circuit board, and a third part making electrical connection with one of said switch plates of said detecting switch, whereby the assembly and construction of the clock is greatly simplified.

2. In a battery powered alarm clock of the type having at least one time wheel; and an alarm switching device comprising at least one detecting wheel whose phase is set in accordance with a desired alarm time, at least one detecting switch which is closed when the phase of the time wheel corresponds to that of the detecting wheel and comprising one of the detecting wheel and time wheel having a projection thereon and the other having a hole therein for receiving the projection upon phase alignment to enable the two wheels to move towards each other and a pressing spring for biasing the two wheels towards each other, and a printed circuit board having alarm circuitry mounted thereon and having at least one land electrically connected to the alarm circuitry, the improvement wherein said alarm switching device further comprises solderless connecting means comprising at least two battery contact plates for contacting the two poles of the battery, wherein one of the plates has three electrically conductive parts including a first part making electrical connection with one pole of the battery, a second part making electrical connection with said land of said printed circuit board, and a third part making electrical connection with said spring of said detecting switch when the wheels move towards each other to effect actuation of the alarm circuitry, whereby the assembly and construction of the clock is greatly simplified.

* * * * *